US009427998B2

(12) United States Patent
Sims

(10) Patent No.: US 9,427,998 B2
(45) **Date of Patent: *Aug. 30, 2016**

(54) METHOD AND APPARATUS FOR FORMING AN IMAGE IN STONE

(71) Applicant: Timothy Andrew Sims, Dunedin, FL (US)

(72) Inventor: Timothy Andrew Sims, Dunedin, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/557,766

(22) Filed: Dec. 2, 2014

(65) Prior Publication Data

US 2015/0083008 A1 Mar. 26, 2015

Related U.S. Application Data

(63) Continuation-in-part of application No. 13/102,313, filed on May 6, 2011, now Pat. No. 8,925,460, which is a continuation-in-part of application No. 11/867,442, filed on Oct. 4, 2007, now Pat. No. 7,958,822.

(51) Int. Cl.

| | |
|---|---|
| ***B41M 5/04*** | (2006.01) |
| ***B41M 5/025*** | (2006.01) |
| ***B44C 1/175*** | (2006.01) |
| ***B44C 5/04*** | (2006.01) |
| *B41M 1/26* | (2006.01) |
| *B41M 1/34* | (2006.01) |
| *B41M 5/035* | (2006.01) |

(52) U.S. Cl.

CPC ..... *B41M 5/025* (2013.01); *B44C 1/175* (2013.01); *B44C 5/0438* (2013.01); *B41M 1/26* (2013.01); *B41M 1/34* (2013.01); *B41M 5/0358* (2013.01); *B41M 5/04* (2013.01); *Y10S 428/914* (2013.01)

(58) Field of Classification Search

None

See application file for complete search history.

(56) References Cited

U.S. PATENT DOCUMENTS

| | | | | |
|---|---|---|---|---|
| 5,916,662 | A | 6/1999 | Schmidt | |
| 6,161,554 | A | 12/2000 | Dunlap-Harris | |
| 6,569,277 | B1 | 5/2003 | Gibbs | |
| 6,686,315 | B1 | 2/2004 | Creed | |
| 7,108,890 | B2 | 9/2006 | Horne et al. | |
| 8,925,460 | B2 * | 1/2015 | Sims | B41M 5/025 101/492 |

FOREIGN PATENT DOCUMENTS

| | | | |
|---|---|---|---|
| JP | 2004076498 | A | 3/2004 |
| RU | 2344940 | C2 | 1/2009 |

* cited by examiner

*Primary Examiner* — Joshua D Zimmerman

(74) *Attorney, Agent, or Firm* — Larson & Larson, P.A.; Frank Liebenow; Patrick Reid

(57) ABSTRACT

A method of imbedding an image in a stone substrate includes printing an image onto a first surface of the stone substrate with regular inks and/or phosphorescent inks. Optionally, a moist towel is placed over the first surface of the stone substrate and a weight is placed over the moist towel then time is provided for the inks of the image to transfer from the print image into the surface of the stone substrate, sublimating into the stone. If provided, the moist towel and the print image are then removed and the above steps are repeated until the image is imbedded into the stone substrate. Optionally, a mirror image of the image is printed on the opposite side of the stone substrate in a similar manner.

20 Claims, 8 Drawing Sheets

METHOD AND APPARATUS FOR FORMING AN IMAGE IN STONE

CROSS-REFERENCE TO RELATED APPLICATIONS

This application is a continuation-in-part of non-provisional patent application Ser. No. 13/102,313, filed May 6, 2011, which in turn is a continuation-in-part of U.S. Pat. No. 7,958,822, issued Jun. 14, 2011.

FIELD

This invention relates to the formation of images in porous solid materials and more particularly to a method and apparatus for forming an image in a sheet of stone.

BACKGROUND

Stone such as marble and granite are used for many purposes including counter tops, door sills, decorative inlays and the like. For many applications, the natural colors and random patterns are desired for aesthetic reasons.

In some applications, it is desired to impregnate the natural stone with a design or image. Such applications include decorative replacements for stained glass and photographic images in monuments, etc. Prior attempts at such have produced limited results with superficial images that wear with time.

Some prior art includes methods of printing on stone. For example, U.S. Pat. No. 5,916,662 to Schmidt shows how to print on a coating on the stone. Unfortunately, the coating covers the stone and detracts from the aesthetic appeal of the stone and the coating can separate from the stone.

U.S. Pat. No. 6,569,277 to Gibbs shows how to transfer an image onto the surface of a material including a leaf and stone. Unfortunately, placing the image on the surface results in an image that is easily scratched.

U.S. Pat. No. 6,686,315 to Creed has a method of making a building material that simulates the look of marble or granite that may include lettering, etc. This method uses a coated substrate as in U.S. Pat. No. 5,916,662 and, therefore, does not present natural stone to the viewer.

U.S. Pat. No. 7,108,890 to Horne, et al, also requires a coating or matrix to be applied to the stone before introducing the image and, therefore, does not present natural stone to the viewer.

What is needed is a method of impregnating a stone material with an image that will augment the natural beauty of the stone with an indelible image.

SUMMARY

In one embodiment, a method of imbedding an image in a stone substrate is disclosed including printing an image onto a first planar surface of a stone by transferring inks directly from a printer to the first planar surface of the stone without the inks being deposited on an intermediate medium then waiting for the inks to transfer into the surface of the stone substrate. The above steps are repeated until the image is imbedded into the stone substrate. Optionally, the above steps are repeated by printing an image (e.g. a mirror image of the image) on the opposite side of the stone.

In another embodiment, a method of imbedding an image in a stone substrate is disclosed including printing an image onto the first surface of the stone substrate by transferring inks directly from a printer to the first planar surface of the stone without the inks being deposited on an intermediate medium then placing a moist towel over the first surface of the stone substrate, placing a weight/mass over the moist towel, and evacuating an opposing surface of the stone substrate. Next, waiting for the image to sublimate into the stone substrate then removing the moist towel and weight/mass. The above steps are then repeated until the image is imbedded into the stone substrate.

In another embodiment, a method of imbedding an image in a sheet of stone is disclosed including printing an image directly onto a first surface of the stone, whereby inks from a printer passes directly from the printer to the first surface of the stone without the inks being deposited on an intermediate medium and evacuating an opposing surface of the stone. Next, wait for the image to sublimate into the stone and then repeat the above steps until the image is imbedded into the stone. Optionally, these steps are repeated, printing an image from the opposite side of the stone, for example, a mirror image of the image is printed from the opposite side of the stone.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
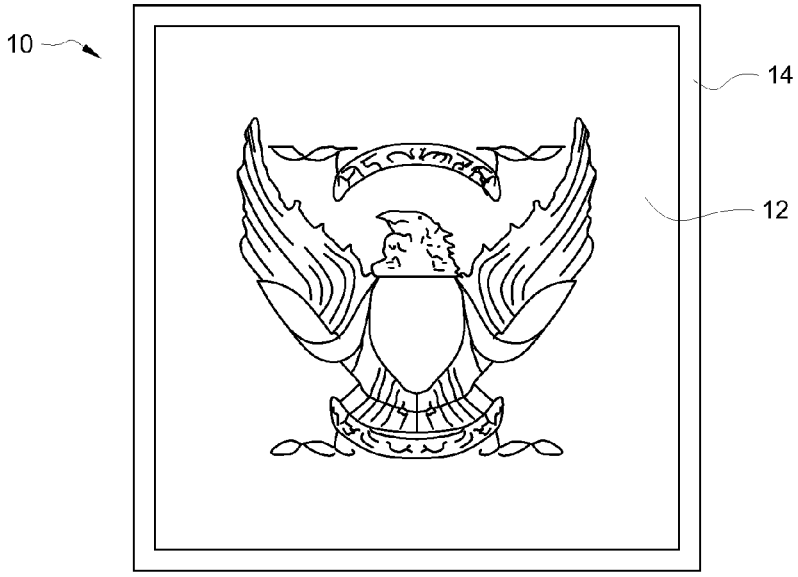
FIG. 1 illustrates an image to be imbedded into a stone substrate.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a front plan view of a printed image 10 to be imbedded into a stone substrate 20 is shown. In some embodiments, the image has a border area 14 where no image is present, usually white.

Figure 2:
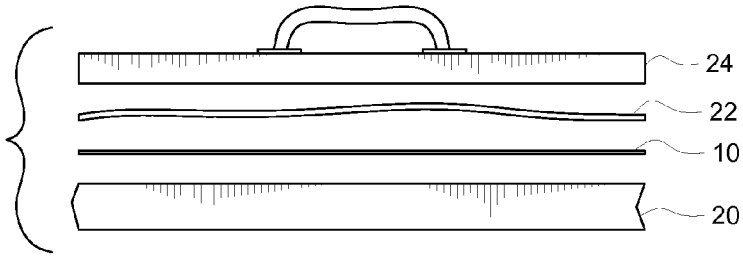
FIG. 2 illustrates a side view of the layers used in creating an image in stone of a first embodiment.

Referring to FIG. 2, a side view of the layers used in creating an image in stone of a first embodiment is shown. To create an image in a stone substrate 20, one or more repetitions of the following steps are performed until the image 12 is imbedded/sublimated in the stone substrate 20, being visible from both sides. The steps include printing an image using a computer printer and placing the image 10 face down on the on the substrate 20, placing a moistened towel 22 completely covering the image 10 and placing a planar weight 24 over the moistened towel 22. The image 10, moistened towel 22 and planar weight 24 are left on the stone substrate 20 for a period of time to allow inks from the printed image to leach into the stone substrate 20. In some embodiments, the image 10, moistened towel 22 and planar weight 24 is left on the stone substrate 20 for from eight to twelve hours. Once the time period is finished, the image 10, moistened towel 22 and planar weight are removed from the stone substrate 20 and the steps repeated as needed using a new printed image 10. In some embodiments, the stone substrate 20 is sanded each time, before applying the image. The grit of the sandpaper is optionally increased (finer) each successive iteration of the method. For example, before the first image is imbedded, a 36-grit cup wheel is used to slightly texture the stone substrate 20. Before the second image is imbedded, 30-grit sandpaper is used to begin to polish the stone substrate 20. Before the third image is imbedded, 50-grit sandpaper is used to further polish the stone substrate 20, and so fourth. It is preferred to use diamond sand paper. Any form of abrasion is anticipated including, but not limited to, we sanding, dry sanding, chemical etching, etc. Being that the image 10 is sublimated into the stone substrate 20, the image 10 remains after abrasion.

It is preferred that the moistened towel be a white towel so as to not introduce any dyes during the image transfer.

The stone substrate 20 is preferably a planar substrate of stone such as marble or granite. A preferred stone substrate 20 is marble. A preferred marble is white Thasos Greek marble. Although the present invention works well on many varieties of stone substrates 20, it has been found that pale white Thasos Greek marble performs best. The image 12 is formed throughout the stone substrate 20; therefore, it is visible from the front side of the stone substrate 20 as well as from the back side of the stone substrate 20, one side being the mirror opposite of the other.

Figure 3:
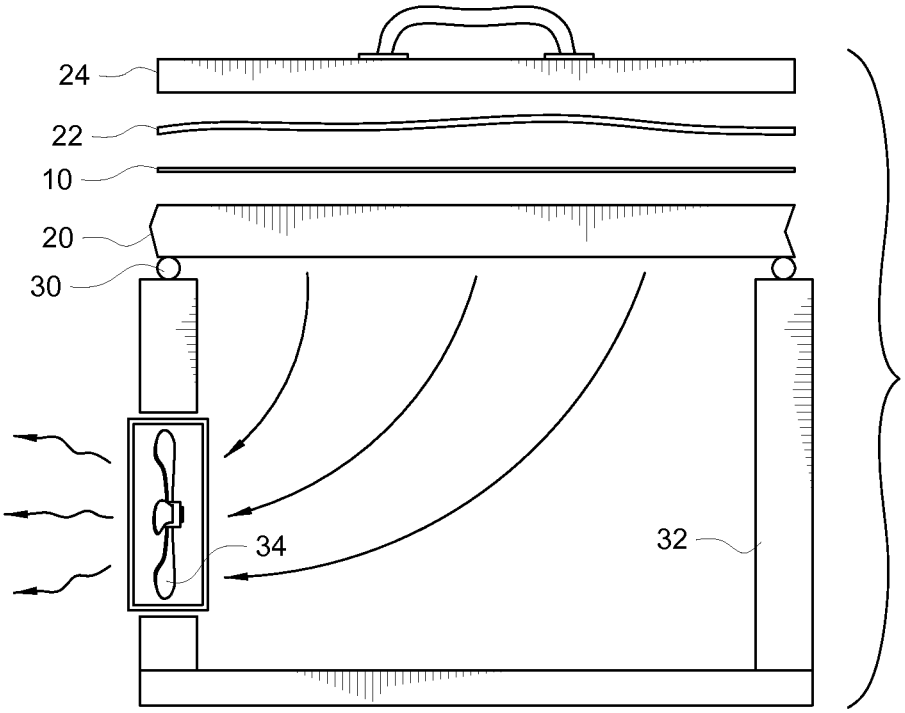
FIG. 3 illustrates a side view of the layers used in creating an image in stone of a second embodiment.

Referring to FIG. 3, a side view of the layers used in creating an image in stone of a second embodiment is shown. In this embodiment, a source of negative air pressure is provided to urge inks from the printed image 10 through the stone substrate 20. To create an image in a stone substrate 20, one or more repetitions of the following steps are performed until the image 12 is imbedded in the stone substrate 20, being visible from both sides. The steps include placing the stone substrate 20 on a negative pressure table 32, placing the image 10 face down on the on the substrate 20, placing a moistened towel 22 completely covering the image 10 and placing a planar weight 24 over the moistened towel 22. The stone substrate 20 is left with the image 10, moistened towel 22 and planar weight 24 for a period of time to allow inks from the printed image to leach into the stone substrate 20. In some embodiments, the stone substrate 20 is left with the image 10, moistened towel 22 and planar weight 24 for from eight to twelve hours. Once the time period is finished, the image 10, moistened towel 22 and planar weight are removed from the stone substrate 20 and the steps repeated as needed using a new printed image 10.

The negative pressure table 32 is a source of negative pressure to urge inks from the printed image 10 through the stone substrate 20. In the example shown, the negative pressure (vacuum) table 32 has a fan 34 for evacuating air from beneath the stone substrate 20. In some embodiments, a gasket 30 is provided to prevent air from leaking in between the stone substrate 20 and the negative pressure table 32.

Figure 4:
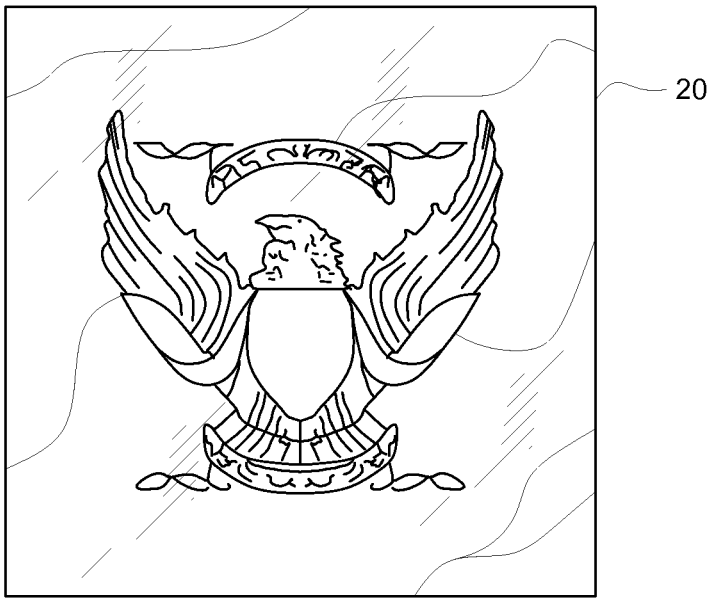
FIG. 4 illustrates a plan view of a finished image in stone.

Referring to FIG. 4, a plan view of a finished image in stone of the present invention is shown. In some embodiments, the printed image 10 is printed as a mirror copy of the final image so that when it is transferred to the stone substrate 20, it appears as the image was intended. In other embodiments, the printed image 10 is printed as a direct copy of the final image so that when it is transferred to the stone substrate 20, it appears as a mirror copy of the final image, but since the image is imbedded in the stone substrate 20, it is visible from the opposite side of the stone substrate 20. Since the image is imbedded within the stone substrate 20, it is possible to polish, sand, grind, sand blast, texture, etc.; the stone substrate without damaging or loosing the image.

Figure 5:
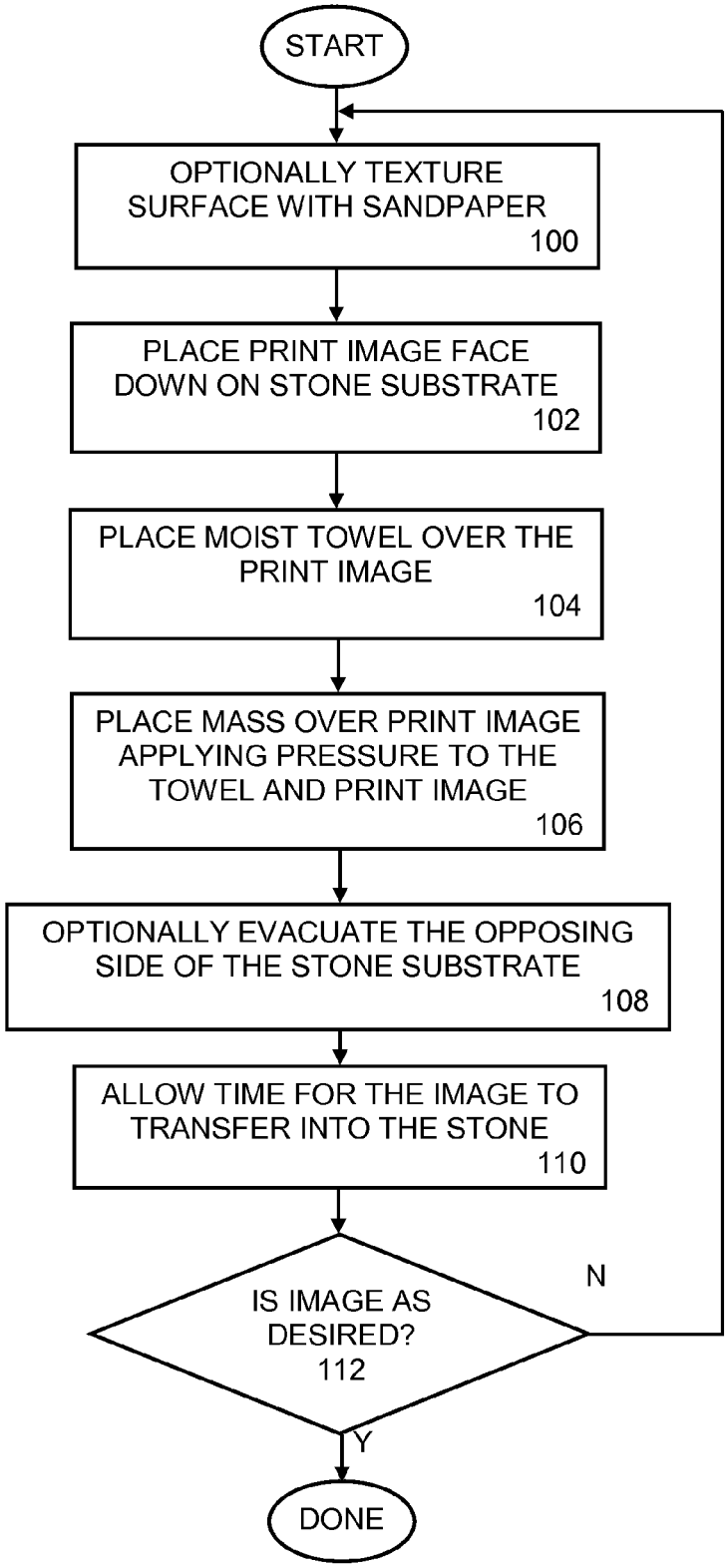
FIG. 5 illustrates a flow chart of a method of imbedding an image in stone.

Referring to FIG. 5, a flow chart of a method of imbedding an image in stone is shown. The first step in creating an image in a stone substrate 20 is to texture 100 the stone substrate 20, preferable with diamond sandpaper. In some embodiments, this step is omitted. The next step is to place a printed image face down 102 on the on the substrate 20. Next, a moistened towel 22 is placed completely covering the image 10. Next, a mass or planar weight 24 is placed 106 over the moistened towel 22. In some embodiments, the steps include evacuating 108 the opposing side of the stone substrate 20, in some embodiments placing the stone substrate 20 on a negative pressure table 32. The image 10, moistened towel 22 and planar weight 24 are left on stone substrate 20 for a period of time 110 to allow inks from the printed image to leach into the stone substrate 20. In some embodiments, the image 10, moistened towel 22 and planar weight 24 are left on the stone substrate 20 for from eight to twelve hours. Once the time period is finished, the image 10, moistened towel 22 and planar weight are removed from the stone substrate 20 and if the image is not yet as clear as desired 112, the steps are repeated as needed using a new printed image 10. It is preferred to repeat the steps with as little time between repetitions so as to preclude the inks from the print image from drying before the next repetition.

Figure 6:
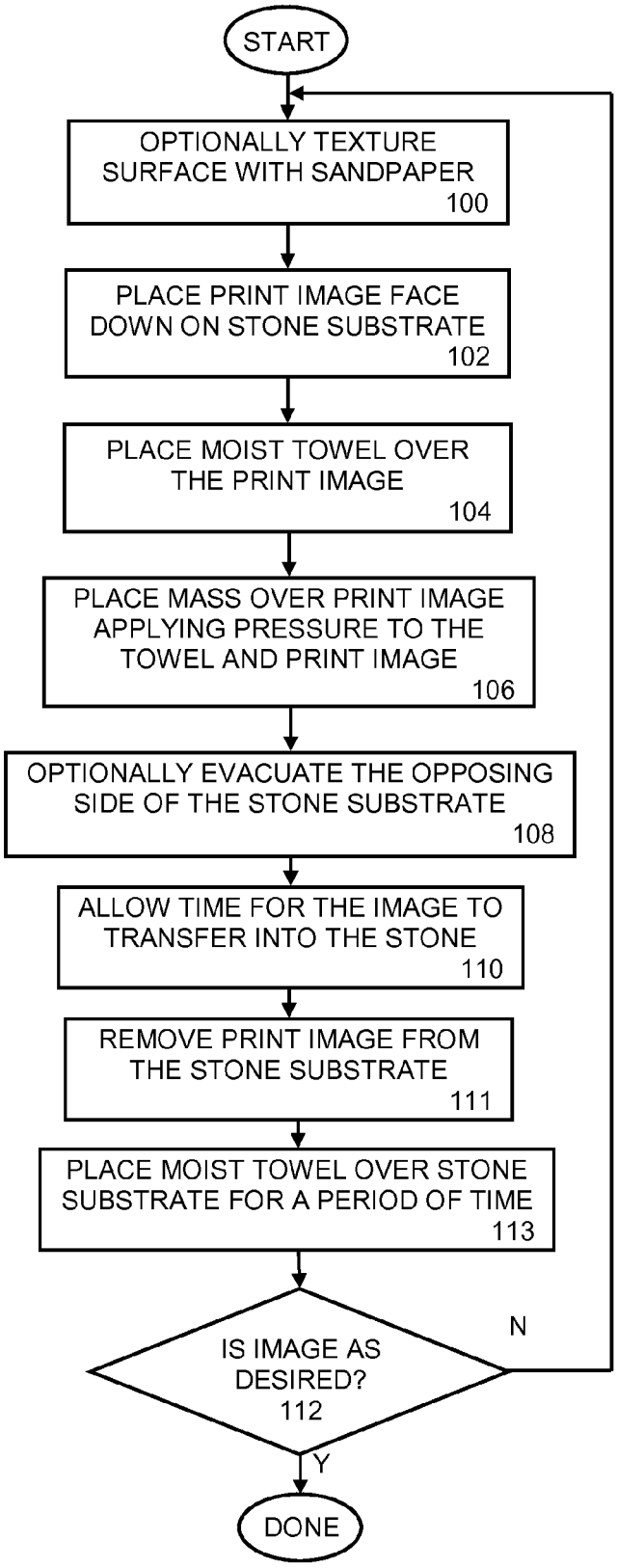
FIG. 6 illustrates a second flow chart of a method of imbedding an image in stone.

Referring to FIG. 6, a second flow chart of a method of imbedding an image in stone is shown. The first step in creating an image in a stone substrate 20 is to texture 100 the stone substrate 20, preferable with diamond sandpaper. In some embodiments, this step is omitted. The next step is to place a printed image face down 102 on the on the substrate 20. Next, a moistened towel 22 is placed completely covering the image 10. Next, a mass or planar weight 24 is placed 106 over the moistened towel 22. In some embodiments, the steps include evacuating 108 the opposing side of the stone substrate 20, in some embodiments placing the stone substrate 20 on a negative pressure table 32. The image 10, moistened towel 22 and planar weight 24 are left on stone substrate 20 for a period of time 110 to allow inks from the printed image to leach into the stone substrate 20. In some embodiments, the image 10, moistened towel 22 and planar weight 24 are left on the stone substrate 20 for from eight to twelve hours 110. Once the time period is finished, the image 10, moistened towel 22 and planar weight are removed 111 from the stone substrate 20 and the moistened towel 22 is placed over the stone substrate 20 and the planar weight 24 is placed over the moistened towel 22 for a period of time 113. Once the planar weight 24 and moist towel 22 is removed, the image is viewed and if the image is not yet as clear as desired 112, the steps are repeated as needed using a new printed image 10. It is preferred to repeat the steps with as little time between repetitions so as to preclude the inks from the print image from drying before the next repetition.

Figure 7:
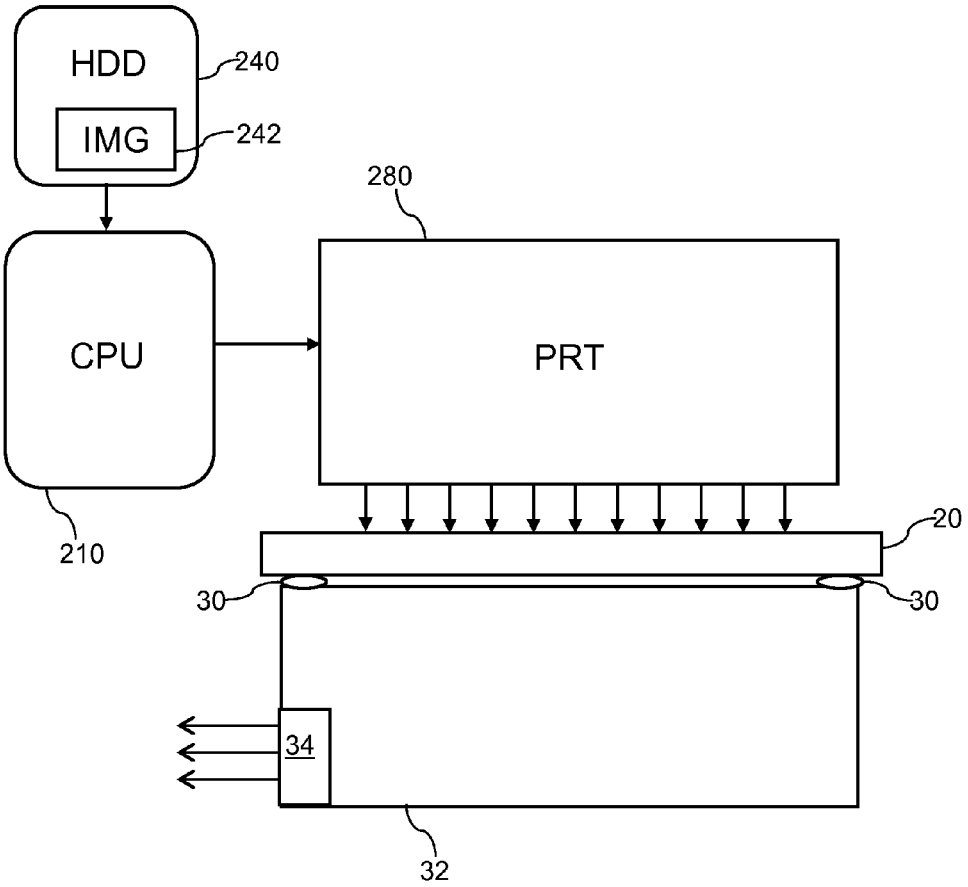
FIG. 7 illustrates a block diagram of a system for printing an image in stone.

Referring to FIG. 7, a block diagram of a system for printing an image in stone will be described. A processing system 210 includes a storage media 240 that has stored there with at least one image file 242. The image file 242 is sent to the printer 280 as known in the industry and the printer 280 prints the image directly onto the stone 20. The stone is optionally situated on a vacuum table 32. The printer 280 deposits ink (any color or type of ink, including plain and phosphorescent inks) in the form of the image on a first side of the stone 20 and the optional vacuum table 32 creates a negative pressure on the opposing side of the stone 20, thereby accelerating the movement/sublimation of the ink into the stone 20. In some embodiments, a gasket 30 is situated between the optional vacuum table 32 and the stone 20. Although any method of evacuating the opposing side of the stone 20 is anticipated, the exemplary vacuum table 32 has a fan 34 that evacuates air from the table 32.

In some embodiments, the stone 20 with printed image is left on the optional vacuum table 32 until the inks are properly sublimated into the stone 20 and/or dries, perhaps for several hours. In some embodiments, after the inks are properly sublimated into the stone 20, the printer 280 reprints the image or prints an overlay, modified image or alternate section of the image on the first side of the stone 20. In this way, the print system provides for stacked layers of ink (again, any color or type of ink, including plain and phosphorescent inks) from the printer 280 to produce greater depth of ink layers and/or dimensional aspects to the finished stone 20.

Figure 8A:
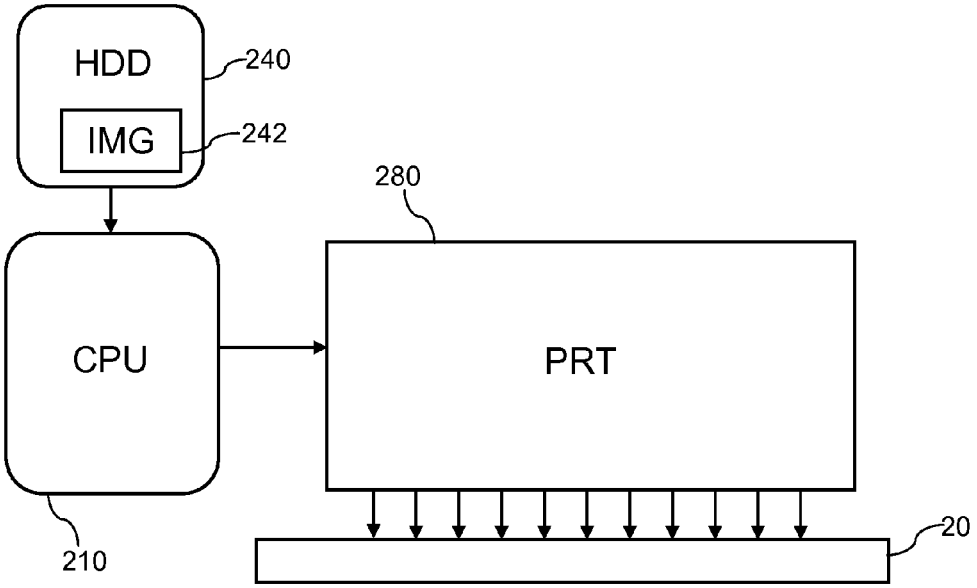
FIG. 8A illustrates a second block diagram of a system for printing an image in stone.
Figure 8B:
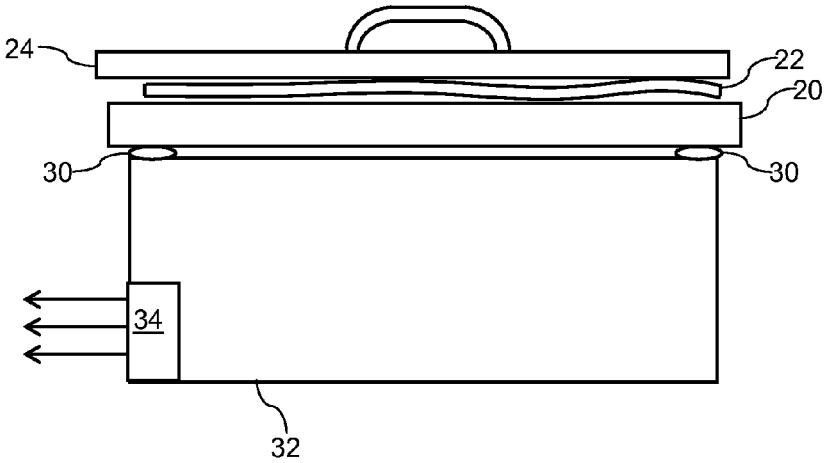
FIG. 8B illustrates a third block diagram of a system for printing an image in stone.

Referring to FIGS. 8A and 8B, block diagrams of a system for printing an image in stone will be described. As in FIG. 7, a processing system 210 includes a storage media 240 that has stored there with at least one image file 242. The image file 242 is sent to the printer 280 as known in the industry and the printer 280 prints the image directly onto the stone 20. The printer 280 deposits ink (any color or type of ink, including plain and phosphorescent inks) in the form of the image on a first side of the stone 20.

After the image is printed on the first side of the stone, the stone is optionally moved onto a vacuum table 32. The optional vacuum table 32 creates a negative pressure on the opposing side of the stone 20, thereby accelerating the movement of the ink into the stone 20. In some embodiments, a gasket 30 is situated between the optional vacuum table 32 and the stone 20. Although any method of evacuating the opposing side of the stone 20 is anticipated, the exemplary vacuum table 32 has a fan 34 that evacuates air from the table 32.

In some embodiments, a moistened towel 22 is placed over the image and stone 20. In some embodiments, a moistened towel 22 is placed over the image and stone 20 and a mass 24 is placed over the moistened towel. This step improves absorption/sublimation into the stone substrate 20.

In some embodiments, the stone 20 with printed image is left on the optional vacuum table 32 until the inks are properly sublimated into the stone 20 and/or dries, perhaps for several hours. In some embodiments, after the inks are properly sublimated into the stone 20, the stone 20 is repositioned against the printer 280 and the printer 280 reprints the image or prints an overlay, modified image or alternate section of the image on the first side of the stone 20. In this way, the print system provides for stacked layers of ink from the printer 280 to produce greater depth of ink layers and/or dimensional aspects to the finished stone 20. After the subsequent print image is deposited, the stone 20 is again optionally moved to the vacuum table 32 and the above steps are repeated. The cycle is repeated as necessary to properly sublimate the image into the stone 20.

Figure 9:
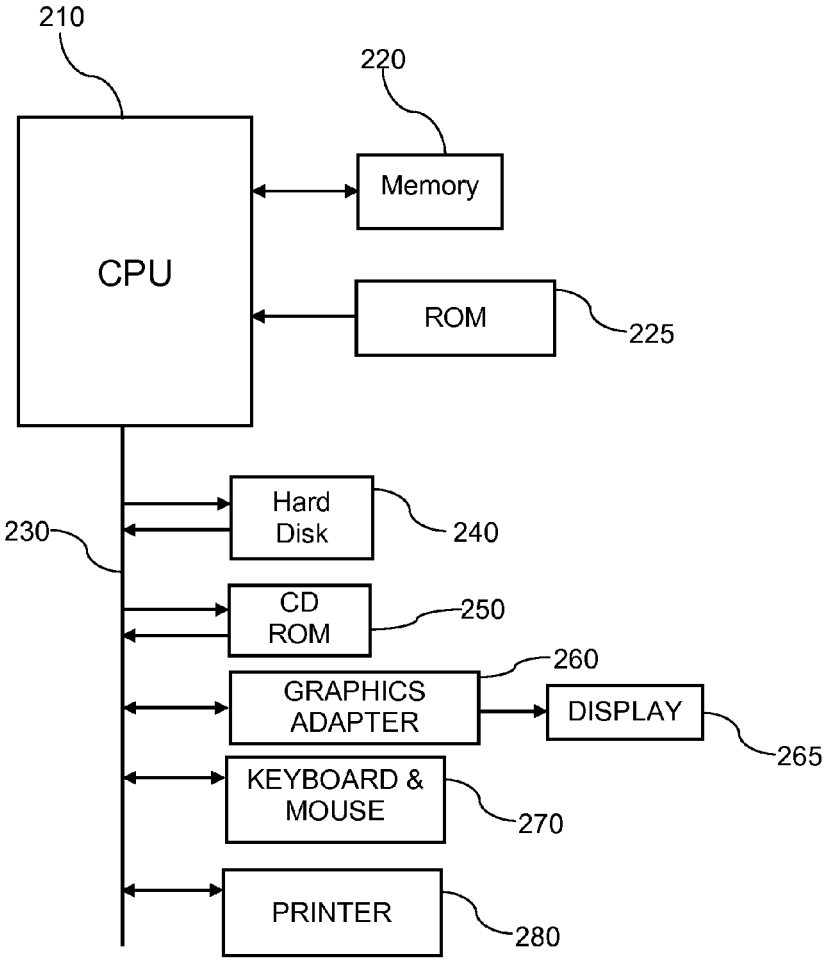
FIG. 9 illustrates a schematic diagram of a typical computer system.

Referring to FIG. 9, a schematic diagram of a computer system will be described. Although shown in its simplest form, having a single processor, many different computer architectures are known that accomplish similar results in a similar fashion and the present invention is not limited in any way to any particular computer system. The present invention works well utilizing a single processor system as shown in FIG. 9, a multiple processor system where multiple processors share resources such as memory and storage, a multiple server system where several independent servers operate in parallel (perhaps having shared access to the data or any combination). In this, a processor 210 is provided to execute stored programs that are generally stored for execution within a memory 220. The processor 210 can be any processor or a group of processors, for example an Intel Pentium-4® CPU or the like. The memory 220 is connected to the processor and can be any memory suitable for connection with the selected processor 210, such as SRAM, DRAM, SDRAM, RDRAM, DDR, DDR-2, etc. Firmware and other parameters are typically stored in read-only memory or flash 225 that is connected to the processor 210 and may include initialization software known as BIOS. The initialization software usually operates when power is applied to the system or when the system is reset.

Also connected to the processor 210 is a system bus 230 for connecting to peripheral subsystems such as a hard disk 240, a CDROM 250, a graphics adapter 260, a keyboard/mouse 270 and a printer 280.

The graphics adapter 260 receives commands and display information from the system bus 230 and generates a display image that is displayed on the display 265.

In general, the hard disk 240 stores programs, executable code and data persistently, while the CDROM 250 provides removable media storage. These peripherals are meant to be examples of input/output devices, persistent storage and removable media storage. Other examples of persistent storage include core memory, FRAM, flash memory, etc. Other examples of removable media storage include CDRW, DVD, DVD writeable, compact flash, other removable flash media, floppy disk, ZIP®, etc. In some embodiments, other devices are connected to the system through the system bus 230 or with other input-output connections. Examples of these devices include printers; graphics tablets; joysticks; and communications adapters such as modems and Ethernet adapters.

Figure 10:
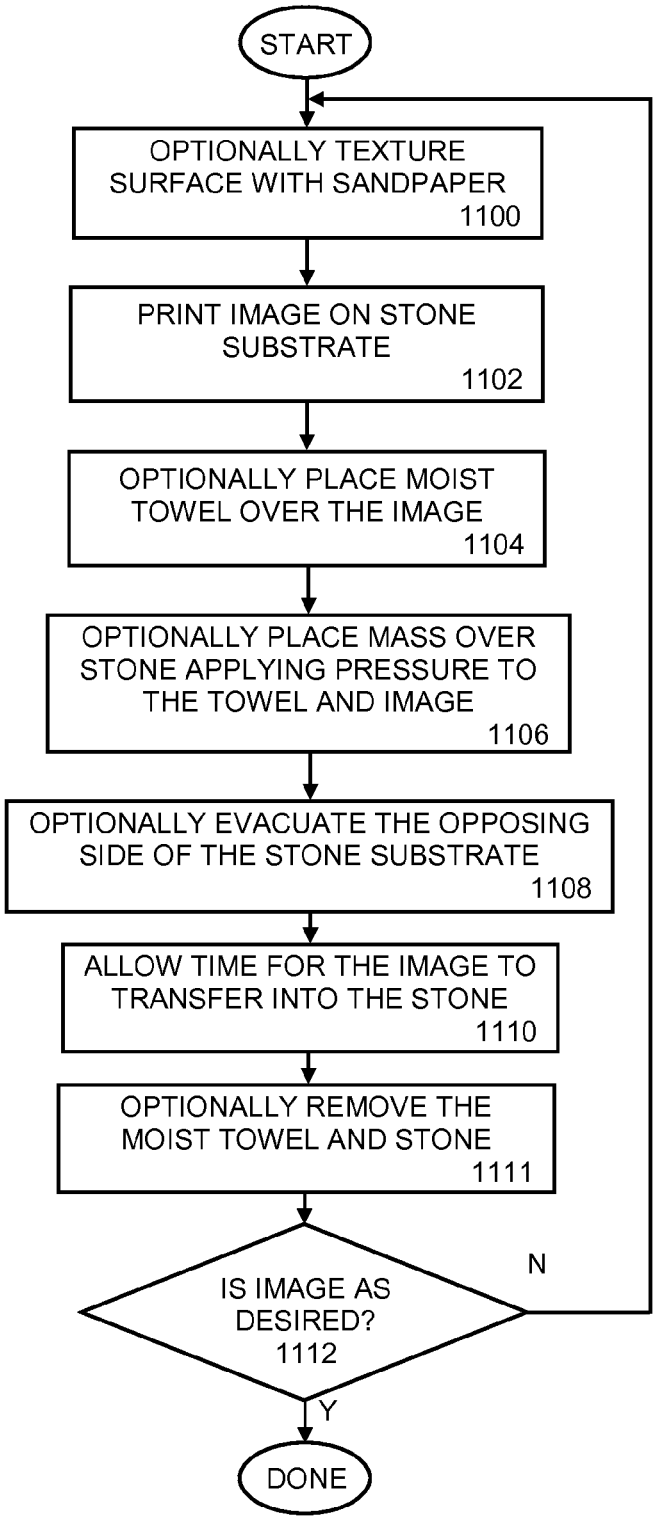
FIG. 10 illustrates a third flow chart of a method of imbedding an image in stone.

Referring to FIG. 10, a third flow chart of a method of imbedding an image in stone will be described. The first step in creating an image in a stone substrate 20, which is optional, is to texture 1100 the stone substrate 20, preferable with diamond sandpaper. Being optional, in some embodiments, this step is omitted. Any form of abrasion is anticipated including, but not limited to, we sanding, dry sanding, chemical etching, etc. Being that the image 10 is sublimated into the stone substrate 20, the image 10 remains after abrasion.

The next step is to print the image 1102 on the substrate 20 using any object printer known in the industry (e.g. printers used for printing on clothing). Although the stone 20 is shown in a fixed location beneath the printer 280 (e.g. the printer's print-head is moved or deflected across the image area), any printer 280 that is capable of printing on a solid object is anticipated, including printers that move over the stone 20 and/or printers that move the stone 20 beneath the print head and/or print area, as known in the industry. Next, a moistened towel 22 is optionally placed 1104 over the image 10. Next, a mass or planar weight 24 is optionally placed 1106 over the moistened towel 22. In some embodiments, the steps include evacuating 1108 the opposing side of the stone substrate 20, for example, placing the stone substrate 20 on a negative pressure table 32. The optional moistened towel 22 and optional planar weight 24 are left over the image on stone substrate 20 for a period of time 1110 to allow inks (any color or type of ink, including plain and phosphorescent inks) from the printed image to sublimate into the stone substrate 20. In some embodiments, the moistened towel 22 and planar weight 24 are left on the image on the stone substrate 20 for from eight to twelve hours. Once the time period completes, the moistened towel 22 and planar weight are removed 1111 from the image on the stone substrate 20. After the planar weight 24 and moist towel 22 is removed, the image is viewed and if the image is not yet as clear as desired 1112, the steps are repeated as needed using a new printed image 10. It is preferred to repeat the steps with as little time between repetitions so as to preclude the inks from completely drying before the next repetition.

It is fully anticipated that an image 10 be printed on one side of the stone 20 and a mirror of the image 10 be printed on the opposite side of the stone 20 for additional effects and clarity. Further, it is fully anticipated that an image 10 be printed on one side of the stone 20 and a modified mirror image 10 be printed on the opposite side of the stone 20 to achieve additional effects and three-dimensional appearances. For example, the outer edges of objects in an image 10 are printed from one side of the stone 20 and the inner areas of the objects in mirror form are printed from the opposite side of the stone 20, yielding an image in stone that appears somewhat three-dimensional.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A method of imbedding an image in a stone substrate, the method comprising:

(a) printing an image onto a first planar surface of a stone by transferring inks directly from a printer to the first planar surface of the stone without the inks being deposited on an intermediate medium;

(b) waiting for the inks to transfer into the surface of the stone substrate;

(c) repeating steps a-b until the image is imbedded into the stone substrate.

2. The method of claim 1, wherein step c includes repeating steps a-b until the image is visible from an opposing surface of the stone substrate opposite the first planar surface of the stone.

3. The method of claim 1, further comprising the steps of:

(a') printing a mirror image of the image onto a second, opposing planar surface of the stone by transferring the inks directly from the printer to the second, opposing planar surface of the stone without the inks being deposited on an intermediate medium;

(b') waiting for the inks from to transfer into the surface of the stone substrate;

(c') repeating steps a'-b' until the mirror image of the image is imbedded into the stone substrate.

4. The method of claim 1, wherein the stone substrate is a planar sheet of marble.

5. The method of claim 4, wherein the marble is white Thasos Greek marble.

6. The method of claim 1, step (d) further comprises the step of evacuating a second, opposing planar surface of the stone substrate.

7. The method of claim 3, step (d') further comprises the step of evacuating the first planar surface of the stone substrate.

8. The method of claim 6, wherein the step of evacuating is performed by placing the stone substrate on a box having an open side where the stone substrate interfaces with the box, the box being sealed, the box having an opening interfaced to a fan for performing the evacuating.

9. The method of claim 7, wherein the step of evacuating is performed by placing the stone substrate on a box having an open side where the stone substrate interfaces with the box, the box being sealed, the box having an opening interfaced to a fan for performing the evacuating.

10. The method of claim 1, wherein at least one of the inks is phosphorescent.

11. The method of claim 1, further comprising the step (x) of sanding the surface of the stone before step (a).

12. The method of claim 11, wherein the step of sanding uses finer grain sandpaper each time step (x) is performed.

13. A method of imbedding an image in a stone substrate, the method comprising:

(a) printing an image onto the first surface of the stone substrate by transferring inks directly from a printer to the first planar surface of the stone without the inks being deposited on an intermediate medium;

(b) placing a moist towel over the first surface of the stone substrate;

(c) placing a weight/mass over the moist towel;

(d) evacuating an opposing surface of the stone substrate;

(e) waiting for the image to sublimate into the stone substrate;

(f) removing the moist towel and weight/mass;

(g) repeating steps a-f until the image is imbedded into the stone substrate.

14. The method of imbedding an image in a stone substrate of claim 13, further comprising the steps of:

(a') printing a mirror image of the image onto an opposing surface of the stone substrate by transferring inks directly from a printer to the opposing surface of the stone without the inks being deposited on an intermediate medium;

(b') placing a moist towel over the opposing surface of the stone substrate;

(c') placing a weight/mass over the moist towel;

(d') evacuating the first surface of the stone substrate;

(e') waiting for the image to sublimate into the stone substrate;

(f') removing the moist towel and weight/mass;

(g') repeating steps a'-f' until the image is imbedded into the stone substrate.

15. The method of claim 14, wherein the stone substrate is a planar sheet of marble.

16. The method of claim 13, wherein at least one of the inks is phosphorescent.

17. A method of imbedding an image in a stone, the method comprising:

(a) printing an image directly onto a first surface of the stone, whereby inks from a printer passes directly from the printer to the first surface of the stone without the inks being deposited on an intermediate medium;

(b) evacuating an opposing surface of the stone;

(c) waiting for the image to sublimate into the stone;

(d) repeating steps a-c until the image is imbedded into the stone.

18. The method of claim 17, wherein at least one of the inks is phosphorescent.

19. The method of claim 17, wherein step d includes repeating steps a-c until the image is visible from the opposing surface of the sheet of stone.

20. The method of claim 17, further comprising the steps of:

(a') printing a mirror image of the image directly onto a second, opposing surface of the stone, whereby inks from the printer passes directly from the printer to the second, opposing surface of the stone without the inks being deposited on an intermediate medium;

(b') evacuating the first surface of the stone;

(c') waiting for the image to sublimate into the stone;

(d') repeating steps a'-c' until the mirror image of the image is imbedded into the stone.

* * * * *